US006671897B1

(12) United States Patent
Votypka

(10) Patent No.: US 6,671,897 B1
(45) Date of Patent: Jan. 6, 2004

(54) LIFT ASSISTING DEVICE AND STABILIZING DEVICE FOR A BATHER AND A SHOWER, RESPECTIVELY

(76) Inventor: Alfred M. Votypka, 511 S. Broadway, Hicksville, NY (US) 11801

( * ) Notice: Subject to any disclaimer, the term of this patent is extended or adjusted under 35 U.S.C. 154(b) by 0 days.

(21) Appl. No.: 10/315,312

(22) Filed: Dec. 9, 2002

(51) Int. Cl.[7] ..... A47K 3/12

(52) U.S. Cl. ..... 4/576.1; 4/571.1; 4/559; 4/604; 182/198

(58) Field of Search ..... 4/576.1, 571.1, 4/559, 573.1, 604; 482/34; 182/198, 206, 195

(56) References Cited

U.S. PATENT DOCUMENTS

| | | | | | |
|---|---|---|---|---|---|
| 271,796 | A | | 2/1883 | Converse | |
| 487,393 | A | * | 12/1892 | Kirchhoff | 182/198 |
| 2,565,978 | A | * | 8/1951 | Meriwether | 248/327 |
| 2,572,615 | A | * | 10/1951 | Hansen | 4/576.1 |
| 3,114,154 | A | * | 12/1963 | Laughlin | 4/576.1 |
| 3,228,038 | A | | 1/1966 | Augustine | |
| 3,696,888 | A | | 10/1972 | Brandenberger | |
| 3,874,375 | A | | 4/1975 | Penner | |
| 4,437,196 | A | * | 3/1984 | Louis | 4/564.1 |
| 4,531,612 | A | * | 7/1985 | Sandor | 182/196 |
| 4,846,306 | A | | 7/1989 | Ventz | |
| 6,230,339 | B1 | | 5/2001 | McCrink | |
| D453,035 | S | | 1/2002 | Giles | |

* cited by examiner

*Primary Examiner*—Gene Mancene
*Assistant Examiner*—Azy Kokabi
(74) *Attorney, Agent, or Firm*—Richard L. Miller

(57) ABSTRACT

A lift assisting device and a stabilizing device for a bather and a showerer, respectively. The device includes a rope and a plurality of rungs. The rope is suspended from a ceiling. The plurality of rungs are operatively connected to the rope for grasping by the bather to assist in lifting and the showerer for stabilizing. The plurality of rungs are molded around the rope so as to form an integral unit therewith. The rope is one-piece for integrity and passes through the plurality of rungs to define a path that is double-helix-like that prevents the bather and the showerer from falling if one of the plurality of rungs fails since double lengths of the rope pass through each of the plurality of rungs.

9 Claims, 1 Drawing Sheet

LIFT ASSISTING DEVICE AND STABILIZING DEVICE FOR A BATHER AND A SHOWER, RESPECTIVELY

BACKGROUND OF THE INVENTION

1. Field of the Invention

The present invention relates to a lift assisting device and stabilizing device. More particularly, the present invention relates to a lift assisting device and a stabilizing device for a bather and a showerer, respectively.

2. Description of the Prior Art

Numerous innovations for assisting devices have been provided in the prior art that will be described. Even though these innovations may be suitable for the specific individual purposes to which they address, however, they differ from the present invention.

A FIRST EXAMPLE, U.S. Pat. No. 271,796 to Converse teaches a fire escape in combination with the rope provided with the hook at its upper end of the steps inserted between the strands of the rope the block and the wire ties substantially as herein shown and described whereby the steps are secured between the strands of the rope and the block secured to the rope and steps by the same tie, as set forth.

A SECOND EXAMPLE, U.S. Pat. No. 3,228,038 to Augustine teaches a safety bar for use with a bathtub with a vertical wall at one end, comprising (a) a main member of generally U-shaped configuration with a bight and two legs extending from the ends of the bight, and (b) a bracket hingedly fastened to the free end of each leg and adapted to be fastened to the wall, the legs extending downwardly away from the wall and the brackets when the bar is in operative position so that the junctions between the legs and the bight rest on the upper surface of the bathtub, each bracket being formed from a single sheet of metal folded into a U-shaped configuration having a central bight adapted to be fastened to the wall and two flanges extending at right angles to the wall in vertical planes, the free end of each leg lying between the flanges of its bracket and being hingedly connected thereto by a horizontal pivot member, the flanges of the bracket extending vertically above the pivot member a substantial distance to embrace a considerable portion of the leg with substantial friction to hold the main member in an inoperative position against the wall.

A THIRD EXAMPLE, U.S. Pat. No. 3,696,888 to Brandenberger teaches a rigid ladder section that is equipped with hooks and rod attachment for hanging over the outside a window sill. One rung of the ladder section is rotatable and carries a rolled up rope or rope ladder which may be released to the ground from high elevations. When not in use as a fire escape the rigid section is equipped with supporting feet and the hooks serve to steady the rod so as to serve as a support for clothes hangers and similar wardrobe holding devices.

A FOURTH EXAMPLE, U.S. Pat. No. 3,874,375 to Penner teaches a back therapy and exercise apparatus having a heavily padded horizontal knee bar made of pipe and with the padding formed of resilient foam material such as foam rubber wrapped with plastic, and a padded toe bar in parallel horizontally spaced relation to the knee bar and also made of pipe. A flexible ladder consisting of horizontal pipe sections supported on chains depends from the opposite ends of the knee bar. A trapeze is positioned with its horizontal bar slightly above and spaced laterally from the knee bar, and a rope having knots at spaced intervals depends from the trapeze to permit a user to grasp the trapeze bar, climb the flexible ladder, hook his knees over the knee bar, hook his toes under the toe bar, and lower himself to an inverted position by means of the knotted rope for the desired length of time.

A FIFTH EXAMPLE, U.S. Pat. No. 4,846,306 to Ventz teaches a flexible narrow rung rope escape ladder including a pair of parallel support ropes and a series of narrow rungs disposed between the support ropes, the support ropes being spaced from each other such that a user's foot placed on the rung cannot slip sideways during use and no more than one hand or one foot can be place don a rung at a time.

A SIXTH EXAMPLE, U.S. Pat. No. 6,230,339 B1 to McCrink teaches a lift assisting device that includes a longitudinal extension member having two angled arms extending outwardly from a wall. The arms are joined together at the wall end to form a loop which pivotally and tightly engages a tubular bar mounted along the wall. The other ends of the arms engage a handle which can be grasped by a person to pull up from a sitting position or lower down from a standing position. The extension member can maintain a longitudinal position extending from the wall or a vertical position along the wall. The preferred use of the extension member is for safely lowering into or rising from a bathtub with the device extending from a wall at the head of the tub.

A SEVENTH EXAMPLE, U.S. Design Pat. No. D 453,035 to Giles teaches the ornamental design for an exercise device.

It is apparent that numerous innovations for assisting devices have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

ACCORDINGLY, AN OBJECT of the present invention is to provide a lift assisting device and a stabilizing device for a bather and a showerer, respectively, that avoids the disadvantages of the prior art.

ANOTHER OBJECT of the present invention is to provide a lift assisting device and a stabilizing device for a bather and a showerer, respectively, that is simple and inexpensive to manufacture.

STILL ANOTHER OBJECT of the present invention is to provide a lift assisting device and a stabilizing device for a bather and a showerer, respectively, that is simple to use.

BRIEFLY STATED, STILL YET ANOTHER OBJECT of the present invention is to provide a lift assisting device and a stabilizing device for a bather and a showerer, respectively. The device includes a rope and a plurality of rungs. The rope is suspended from a ceiling. The plurality of rungs are operatively connected to the rope for grasping by the bather to assist in lifting and the showerer for stabilizing. The plurality of rungs are molded around the rope so as to form an integral unit therewith. The rope is one-piece for integrity and passes through the plurality of rungs to define a path that is double-helix-like that prevents the bather and the showerer from falling if one of the plurality of rungs fails since double lengths of the rope pass through each of the plurality of rungs.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures of the drawing are briefly described as follows.

LIST OF REFERENCE NUMERALS UTILIZED IN THE DRAWING

Figure 1:
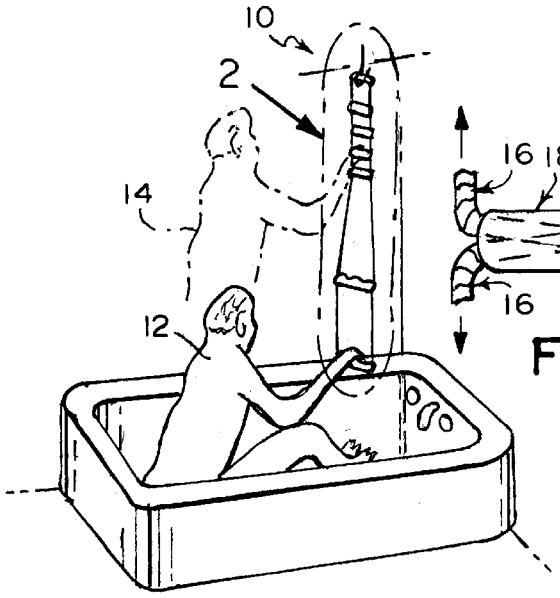
FIG. 1 is a diagrammatic perspective view of the present invention in use as a lifting assisting device for a bather.
Figure 5:
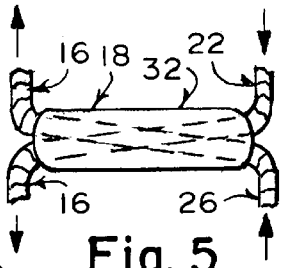
FIG. 5 is an enlarged diagrammatic front elevational view of the area generally enclosed by the dotted curve identified by arrow 5 in FIG. 2 of a showerer stabilizing rung of the present invention.

| | |
|---|---|
| 10 | lift assisting device and stabilizing device of present invention for bather 12 and showerer 14, respectively |
| 12 | bather |
| 14 | showerer |
| 16 | rope for suspending from ceiling 20 |
| 18 | plurality of rungs for grasping by bather 12 and showerer 14 |
| 20 | ceiling |
| 22 | upper portion of rope 16 for being secured to ceiling 20 by way of hook 28 that threadably engages in ceiling joist 30 and engages upper portion 22 of rope 16 |
| 24 | lower portion of rope 16 |
| 26 | intermediate portion of rope 16 |
| 28 | hook |
| 30 | ceiling joist |
| 32 | plurality of upper rungs of plurality of rungs 18 |
| 34 | plurality of lower rungs of plurality of rungs 18 |
| 36 | uppermost area of upper portion 22 of rope 16 |
| 38 | uppermost rung of plurality of upper rungs 32 of plurality of rungs 18 for being received by hook 28 |
| 40 | lowermost area of lower portion 24 of rope 16 |
| 42 | lowermost rung of plurality of lower rungs 34 of plurality of rungs 18 |

DETAILED DESCRIPTION OF THE PREFERRED EMBODIMENT

Referring now to the figures, in which like numerals indicate like parts, and particularly to FIG. 1 the lift assisting device and the stabilizing device of the present invention is shown generally at 10 for a bather 12 and a showerer 14, respectively.

The overall configuration of the lift assisting device and the stabilizing device 10 can best be seen in FIG. 2, and as such, will be discussed with reference thereto.

The lift assisting device and the stabilizing device 10 comprises a rope 16 and a plurality of rungs 18. The rope 16 is for suspending from a ceiling 20. The plurality of rungs 18 are operatively connected to the rope 16 and are for grasping by the bather 12 and the showerer 14.

The rope 16 is one-piece for integrity and has an upper portion 22, a lower portion 24, and an intermediate portion 26. The upper portion 22 of the rope 16 is for being secured to the ceiling 20 by way of a hook 28 that threadably engages in a ceiling joist 30 and engages the upper portion 22 of the rope 16. The intermediate portion 26 of the rope 16 extends from the upper portion 22 of the rope 16 to the lower portion 24 of the rope 16.

The plurality of rungs 18 comprise a plurality of upper rungs 32 and a plurality of lower rungs 34. The plurality of upper rungs 32 are operatively connected to the upper portion 22 of the rope 16, the plurality of lower rungs 34 are operatively connected to the lower portion 24 of the rope 16, and the intermediate portion 26 of the rope 16 is free of any of the plurality of rungs 18.

The upper portion 22 of the rope 16 has an uppermost area 36 and the plurality of upper rungs 32 comprise an uppermost rung 38. The uppermost rung 38 of the plurality of upper rungs 32 is operatively connected to the uppermost area 36 of the upper portion 22 of the rope 16 and is for being received by the hook 28.

The lower portion 24 of the rope 16 has a lowermost area 40 and the plurality of lower rungs 34 comprise a lowermost rung 42. The lowermost rung 42 of the plurality of lower rungs 34 is operatively connected to the lowermost area 40 of the lower portion 24 of the rope 16.

Each of the plurality of lower rungs 34 has a length that is greater than that of each of the plurality of upper rungs 32, since the bather 12 usually uses two hands to grip one of the plurality of lower rungs 34 to assist in lifting, while the showerer 14 usually uses only one hand to grip one of the plurality of upper rungs 32 to stabilize.

The interconnection of the rope 16 and the plurality of rungs 18 can best be seen in FIGS. 2–5, and as such, will be discussed with reference thereto. The rope 16 is also shown in dotted lines in FIG. 2 to assist in the comprehension of the path of the rope 16.

Figure 2:
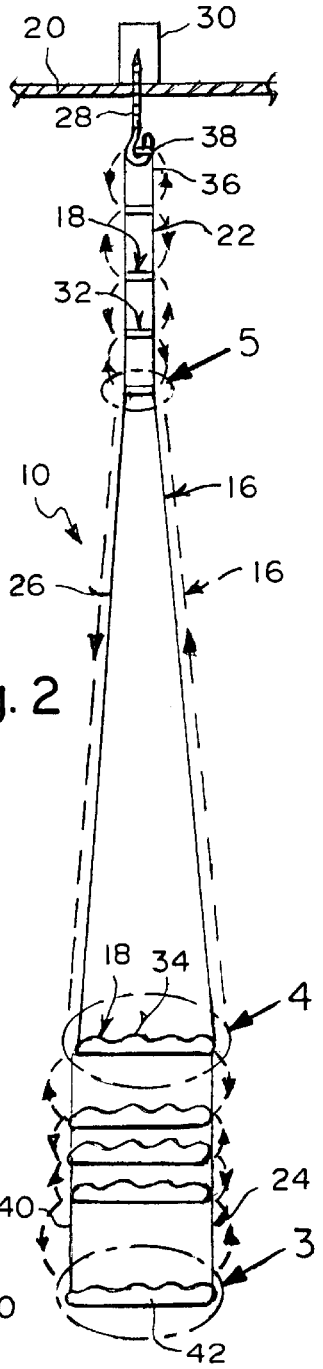
FIG. 2 is an enlarged diagrammatic front elevational view of the area generally enclosed by the dotted curve identified by arrow 2 in FIG. 1 of the present invention.
Figure 4:
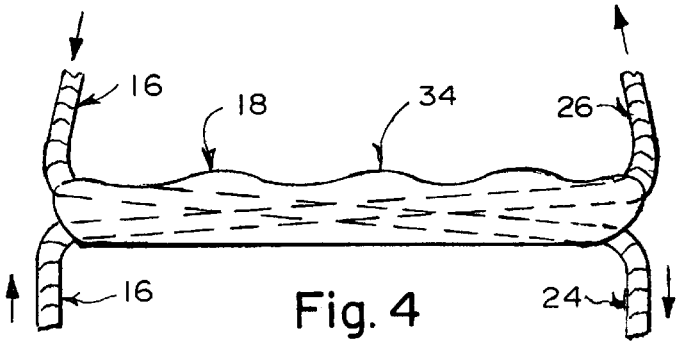
FIG. 4 is an enlarged diagrammatic front elevational view of the area generally enclosed by the dotted curve identified by arrow 4 in FIG. 2 of the uppermost bather lift assisting rung of the present invention.
Figure 3:
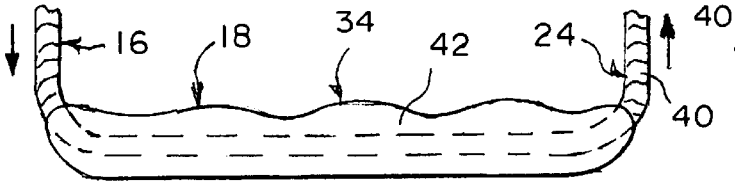
FIG. 3 is an enlarged diagrammatic front elevational view of the area generally enclosed by the dotted curve identified by arrow 3 in FIG. 2 of the lowermost bather lift assisting rung of the present invention.

As shown in FIG. 2, the rope 16 enters one end of the uppermost rung 38, with an initial end of the rope 16 extending outwardly therefrom, and exists the uppermost rung 38 from the other end thereof, then depends therefrom and enters an adjacent end of a next lower one of the plurality of upper rungs 32 and exists the next lower one of the plurality of upper rungs 32 from the other end thereof, then depends therefrom and enters an adjacent end of a next lower one of the plurality of upper rungs 32 and exists the next lower one of the plurality of upper rungs 32 from the other end thereof, and so on until entering an adjacent end of a lowermost one of the plurality of upper rungs 32 and exists the lowermost one of the plurality of upper rungs 32 from the other end thereof (FIGS. 2 and 5), then depends therefrom and enters an adjacent end of an uppermost one of the plurality of lower rungs 34 and exists the uppermost one of the plurality of lower rungs 34 from the other end thereof (FIGS. 2 and 4), then depends therefrom and enters an adjacent end of a next lower one of the plurality of lower rungs 34 and exists the next lower one of the plurality of lower rungs 34 from the other end thereof, and so on until entering an adjacent end of the lowermost rung 42 of the plurality of lower rungs 34 and exists the lowermost rung 42 of the plurality of lower rungs 34 from the other end thereof (FIGS. 2 and 3), then extends upwardly therefrom and enters the adjacent end of the next lower one of the plurality of lower rungs 34 and exists the next lower one of the plurality of lower rungs 34 from the other end thereof, then extends upwardly therefrom and enters the adjacent end of the next lower one of the plurality of lower rungs 34 and exists the next lower one of the plurality of lower rungs 34 from the other end thereof, and so on until entering the adjacent end of the uppermost rung of the plurality of lower rungs 34 and exists the uppermost rung of the plurality of lower rungs 34 from the other end thereof (FIGS. 2 and 4), then extends upwardly therefrom and enters the adjacent end of the lowermost rung of the plurality of upper rungs 32 and exists the lowermost rung of the plurality of upper rungs 32 from the other end thereof (FIGS. 2 and 5), then extends upwardly therefrom and enters the adjacent end of the next lower one of the plurality of upper rungs 32 and exists the next lower one of the plurality of upper rungs 32 from the other end thereof, then extends upwardly therefrom and enters the adjacent end of the next lower one of the plurality of upper rungs 32 and exists the next lower one of the plurality of upper rungs 32 from the other end thereof, and so on until entering the one end of the uppermost rung 38 of the plurality of upper rungs 32 and exists the uppermost rung of the plurality of upper rungs 32 from the other end thereof in a terminal end which is tied to the initial end of the rope 16 so as to define a path of the rope 16 that is double-helix-like that prevents the bather 12 and the showerer 14 from falling if one of the plurality of rungs 18 fails since double lengths of the rope 16 pass through each of the plurality of rungs 18.

The plurality of rungs 18 are molded around the rope 16 so as to form an integral unit therewith.

It will be understood that each of the elements described above, or two or more together, may also find a useful application in other types of constructions differing from the types described above.

While the invention has been illustrated and described as embodied in a lift assisting device for a bather and stabilizing device for a showerer, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A lift assisting device and a stabilizing device for a bather and a showerer, respectively, said device comprising:

a) a rope;

b) a plurality of rungs;

wherein said rope is for suspending from a ceiling;

wherein said plurality of rungs are operatively connected to said rope; and wherein said plurality of rungs are for grasping by the bather and the showerer, wherein said rose has an upper portion;

wherein said rose has a lower portion;

wherein said rose has an intermediate portion;

wherein said upper portion of said rope is for being secured to the ceiling by way of a hook;

wherein the hook threadably engages in a ceiling joist;

wherein the hook engages said upper portion of said rope; and wherein said intermediate portion of said rope extends from said upper portion of said rope to said lower portion of said rope, wherein said plurality of rungs comprise a plurality of upper rungs; and wherein said plurality of rungs comprise a plurality of lower rungs, wherein each of said plurality of lower rungs has a length; and wherein said length of each of said plurality of lower rungs is greater than that of each of said plurality of upper rungs, since the bather usually uses two hands to grip one of said plurality of lower rungs to assist in lifting, while the showerer usually uses only one hand to grip one of said plurality of upper rungs to stabilize.

2. The device as defined in claim 1, wherein said rope is one-piece for integrity.

3. The device as defined in claim 1, wherein said plurality of upper rungs are operatively connected to said upper portion of said rope; and wherein said plurality of lower rungs are operatively connected to said lower portion of said rope.

4. The device as defined in claim 1, wherein said intermediate portion of said rope is free of any of said plurality of rings.

5. The device as defined in claim 1, wherein said plurality of rungs are modeled around said rope so as to form an integral unit therewith.

6. A lift assisting device and a stabilizing device for a bather and a showerer, respectively, said device comprising:

a) a rope;

b) a plurality of rungs;

wherein said rose is for suspending from a ceiling;

wherein said plurality of rungs are operatively connected to said rope; and wherein said plurality of rungs are for grasping by the bather and the showerer, wherein said rope has an upper portion;

wherein said rope has a lower portion;

wherein said rope has an intermediate portion;

wherein said upper portion of said rope is for being secured to the ceiling by way of a hook;

wherein the hook threadably engages in a ceiling joist;

wherein the hook engages said upper portion of said rope; and wherein said intermediate portion of said rope extends from said upper portion of said rope to said lower portion of said rope, wherein said upper portion of said rope has an uppermost area;

wherein a plurality of upper rungs comprise an uppermost rung;

wherein said uppermost rung of said plurality of upper rungs is operatively connected to said uppermost area of said upper portion of said rope; and wherein said uppermost rung of said plurality of upper rungs is for being received by the hook, wherein said lower portion of said rope has a lowermost area;

wherein a plurality of lower rungs comprise a lowermost rung; and wherein said lowermost rung of said plurality of lower rungs is operatively connected to said lowermost area of said lower portion of said rope, wherein said rope enters one end of said uppermost rung of said upper portion of said plurality of rungs, with an initial end of said rope extending outwardly therefrom, and exists said uppermost rung of said upper portion of said plurality of rungs from the other end thereof, then depends therefrom and enters an adjacent end of a next lower one of said plurality of upper rungs and exists said next lower one of said plurality of upper rungs from the other end thereof, then depends therefrom and enters an adjacent end of a next lower one of said plurality of upper rungs and exists said next lower one of said plurality of upper rungs from the other end thereof, and so on until entering an adjacent end of a lowermost one of said plurality of upper rungs and exists said lowermost one of said plurality of upper rungs from the other end thereof, then depends therefrom and enters an adjacent end of an uppermost one of said plurality of lower rungs and exists said uppermost one of said plurality of lower rungs from the other end thereof, then depends therefrom and enters an adjacent end of a next lower one of said plurality of lower rungs and exists said next lower one of said plurality of lower rungs from the other end thereof, and so on until entering an adjacent end of said lowermost rung of said plurality of lower rungs and exists said lowermost rung of said plurality of lower rungs from the other end thereof, then extends upwardly therefrom and enters said adjacent end of said next lower one of said plurality of lower rungs and exists said next lower one of said plurality of lower rungs from said other end thereof, then extends upwardly therefrom and enters said adjacent end of said next lower one of said plurality of lower rungs and exists said next lower one of said plurality of lower rungs from said other end thereof, and so on until entering said adjacent end of an uppermost rung of said plurality of lower rungs and exists said uppermost rung of said plurality of lower rungs from said other end thereof, then extends upwardly therefrom and enters said adjacent end of said lowermost rung of said plurality of upper rungs and exists said lowermost rung of said plurality of upper rungs from said other end thereof, then extends upwardly therefrom and enters said adjacent end of said next lower one of said plurality of upper rungs and exists said next lower one of said plurality of upper rungs from said other end thereof, then extends upwardly therefrom and enters said adjacent end of said next lower one of said plurality of upper rungs and exists said next lower one of said plurality of upper rungs from said other end thereof, and so on until entering said one end of said uppermost rung of said plurality of upper rungs and exists said uppermost rung of said plurality of upper rungs from said other end thereof in a terminal end which is tied to said initial end of said rope so as to define a path of said rope that is double-helix-like that prevents the bather and the showerer from falling if one of said plurality of rungs fails since double lengths of said rope pass through each of said plurality of rungs.

7. The device as defined in claim 6, wherein said rope is one-piece for integrity.

8. The device as defined in claim 6, wherein said intermediate portion of said rope is free of any of said plurality of rings.

9. The device as defined in claim 6, wherein said plurality of rungs are molded around said rope so as to form an integral unit therewith.

* * * * *